US007027966B2

(12) United States Patent
Klauder, Jr.

(10) Patent No.: US 7,027,966 B2
(45) Date of Patent: Apr. 11, 2006

(54) RAILROAD CURVE TRANSITION SPIRAL DESIGN METHOD BASED ON CONTROL OF VEHICLE BANKING MOTION

(76) Inventor: Louis T. Klauder, Jr., 833 Galer Dr., Newtown Square, PA (US) 19073

( * ) Notice: Subject to any disclaimer, the term of this patent is extended or adjusted under 35 U.S.C. 154(b) by 604 days.

(21) Appl. No.: 10/311,613

(22) PCT Filed: Jun. 20, 2001

(86) PCT No.: PCT/US01/41074

§ 371 (c)(1),
(2), (4) Date: Dec. 17, 2002

(87) PCT Pub. No.: WO01/98938

PCT Pub. Date: Dec. 27, 2001

(65) Prior Publication Data

US 2003/0204385 A1 Oct. 30, 2003

Related U.S. Application Data

(60) Provisional application No. 60/294,288, filed on May 31, 2001, provisional application No. 60/292,037, filed on May 21, 2001, provisional application No. 60/212,499, filed on Jun. 20, 2000.

(51) Int. Cl.
*G06F 17/10* (2006.01)

(52) U.S. Cl. ..... 703/2; 703/7; 701/19; 104/7.1

(58) Field of Classification Search ..... 703/2, 703/7; 701/19; 105/355; 104/7.1, 7.2, 164, 104/189

See application file for complete search history.

(56) References Cited

U.S. PATENT DOCUMENTS

| | | | | |
|---|---|---|---|---|
| 3,732,827 | A * | 5/1973 | Anderson | 104/7.1 |
| 3,905,568 | A | 9/1975 | Watanabe et al. | |
| 4,323,013 | A * | 4/1982 | Theurer | 104/7.2 |
| 4,693,183 | A | 9/1987 | Pötzsch | |
| 4,860,666 | A | 8/1989 | Smith | |
| 5,012,413 | A * | 4/1991 | Sroka et al. | 701/19 |
| 5,791,254 | A | 8/1998 | Mares et al. | |
| 5,988,519 | A | 11/1999 | Jordie | |

(Continued)

OTHER PUBLICATIONS

Krueger et al., H. Simulations within the railroad environment, Proceedings of the 32nd Conference on Winter Simulation, Dec. 2000, pp. 1191-1200.*

(Continued)

*Primary Examiner*—Russell Frejd
(74) *Attorney, Agent, or Firm*—Gary M. Cohen

(57) ABSTRACT

Transition spirals for successive sections of railroad track with different degrees of curvature are designed by first specifying the manner in which the bank angle of the track should change with distance along a transition spiral. Functional forms for bank angle are provided as a function of distance along the spiral, which can also be used in traditional conceptual frameworks, and interpreted in that context to define track curvature as a function of distance. Also included are functional forms obtained by raising the longitudinal axis about which bank angle change takes place so that the axis is above the plane of the track. The resulting transition spirals reduce the transient lateral accelerations to which passengers are subjected when passenger vehicles traverse the spirals and reduce the damaging transient lateral forces that heavy freight locomotives and freight cars apply to the track structure near the ends of the spirals.

9 Claims, 6 Drawing Sheets

U.S. PATENT DOCUMENTS

| | | | | |
|---|---|---|---|---|
| 6,257,494 | B1 | 7/2001 | Tokuoka et al. | |
| 6,347,265 | B1 * | 2/2002 | Bidaud | 701/19 |
| 2001/0010197 | A1 * | 8/2001 | Kassab | 105/355 |

OTHER PUBLICATIONS

Steenblik et al., R.A. Numerical modeling of the conformational transition of a spiral focusing surface, ACM SIGSIM Simulation Digest, Proceedings of the 23rd Annual Symposium on Simulation, Apr. 1990, pp. 127-134.*

Belzer, J. Geometrics of spiral bridge design, 13th National Meeting of the Association for Computing Machinery, Jun. 1958, pp. 13-1-13.3.*

Ahmadian, Mehdi, "Filtering Effects of Mid-Cord Offset Measurements on Track Geometry Data", Proceedings of the 1999 ASME/IEEE Joint Railroad Conference, pp. 157-161 (1999).

Kufver, Björn, VTI Report 420A, "Mathematical Description of Railway Alignments and Some Preliminary Comparative Studies", Swedish National Road and Transport Research Institute (1997), pp. 1-4, 9-12 and 41-60.

Presle, Gérard, et al., "Entwicklung und Grundlagen neuer Gleisgeometrie", ZEV + DET Glas. Ann. 122 (1998) 9/10, Sep./Oct., pp. 579-586.

* cited by examiner

RAILROAD CURVE TRANSITION SPIRAL DESIGN METHOD BASED ON CONTROL OF VEHICLE BANKING MOTION

CROSS-REFERENCE TO RELATED APPLICATIONS

This application claims the benefit of U.S. Provisional Application No. 60/212,499, filed Jun. 20, 2000; U.S. Provisional Application No. 60/292,037, filed May 21, 2001; and U.S. Provisional Application No. 60/294,288, filed May 31, 2001.

BACKGROUND OF THE INVENTION

Most railroad track can be divided into alternating sections of straight track and of curved track. Each section of curved track can in turn be divided into sections in which the curvature is constant throughout the section and sections in which the curvature varies with distance along the section. In a section of straight track the bank angle of the track is normally zero (with a possible exception near either end of the section). In a section of curved track that has constant curvature and that is not restricted to very low train speed the bank angle is normally greater than zero and constant (again with a possible exception near either end of the section).

Between a section of straight track with zero bank angle and a section of curved track with curvature and bank angle constant and non-zero it is necessary to have a transition section in which bank angle varies with distance so as to match the adjacent bank angle at each end. Normally the curvature of such a transition section also varies with distance and matches the curvature of the adjacent section at each end. Such a transition is referred to as a spiral. In the original and most widely used spiral the bank angle and curvature both vary linearly with distance along the transition section. A spiral in which the curvature varies linearly with distance has an alignment shape referred to in the railroad industry as a clothoid spiral.

The bank angle of the track will be generally referred to hereinafter as the "roll angle". The roll angle of the track will determine and be the same as the roll angle of a vehicle wheel set about the longitudinal axis (i.e., the axis that is in the plane of the track and that is parallel to the local direction of the track). Roll in the sense of banking as used herein should not be confused with roll in the sense that a vehicle wheel rolls about an axis that is in the plane of the track but approximately perpendicular to the local direction of the track.

The description of this invention will refer to the curvature of the track. The curvature of the track is a property of the alignment of the track as seen in plan view. It is equal to the derivative of the local compass direction of the track (in radians) with respect to distance along the track. The curvature at a point on the track is also equal to the reciprocal of the radius of a circle for which the derivative of the compass bearing along the periphery with respect to peripheral distance is the same as that of the spiral.

The description of this invention will refer to the "offset" between two neighboring sections of track, each of which has constant curvature. The offset between two such adjacent track sections is the smallest distance between extensions of the sections that maintain their respective fixed curvatures. The offset can be assumed to be greater than zero and must be so in order for adjacent constant curvature sections to be connected by a spiral with monotonically varying curvature.

It has long been recognized that when a rail vehicle travels over a clothoid spiral the vehicle is subjected to abrupt lateral and roll accelerations that cause a little discomfort to passengers and whose reaction forces on the track structure degrade the alignment of the track. As a result, a number of alternate forms of variation of spiral curvature with distance have been proposed, some of which have been used in practice. Alternate methods for design of railroad transition spirals that have been proposed and used in the past are described in Bjorn Kufver, VTI Report 420A, "Mathematical Description of Railway Alignments and Some Preliminary Comparative Studies", Swedish National Road and Transport Research Institute (1997).

In addition, there has been consideration of the height of the roll axis, which is the longitudinal axis about which the track is rotated for purpose of changing the roll angle. It has been proposed and proven in practice that spiral performance can be substantially improved if the roll axis is raised above the plain of the track. This technique is described in Gerard Presle and Herbert L. Hasslinger, "Entwicklung und Grundlagen neuer Gleisgeometrie", ZEV+DET Glas. Ann. 122, 1998, 9/10, September/October, page 579.

All of the previously published methods for design of a railroad spiral begin by specifying a functional form for the curvature of the track as a function of distance along the spiral. Also, to the extent presently known, all of the previously published formulae for curvature of spirals lead to a discontinuity in the third derivative of the track curvature at each end of the spiral.

SUMMARY OF THE INVENTION

The present invention provides an improved method for the design of railroad track curve transition spirals. In accordance with the invention, the method begins not by specifying how track curvature should vary as a function of distance along a spiral but rather by specifying the manner in which the roll angle of the track should change as a function of distance along a spiral. In the description which follows, a mathematical expression used to specify how the roll angle changes with distance along a spiral is referred to as a "roll function". In the method of this invention, the first step is the choice of a roll function. One reason that beginning with the roll motion is an advantage is that it encourages a user of the method to take the point of view that efficient management of the dynamics of the roll motion that occurs as a vehicle traverses a spiral should be a primary objective of the design of the spiral.

After a roll function has been selected and the first step is thereby completed, additional steps are applied to the selected roll function and yield a definite spiral shape that will provide a transition between the constant curvature track sections at the two ends of the spiral.

In contrast to prior methods, this invention includes a number of roll functions that have been specifically designed to be suitable for selection in the first step of the method and that have not been proposed heretofore for the design of track transition spirals.

The roll functions that are included in this invention have been devised for use in the method of this invention. However, such roll functions can also be put to an alternate use in the context of the traditional method of spiral design that begins not with specification of the roll of the track but rather with specification of the curvature of the track. This alternate use is accomplished by taking a roll function of this invention and interpreting it not as specifying the roll of the track versus distance but rather as defining the curvature of the track versus distance by being linearly related thereto. The two coefficients of the linear relationship are fixed by the requirement that the curvature at each end of the spiral is to be the same as the curvature of the respective neighboring track section. This alternate use is possible because in the applicable balance equation, described below, the roll angle is usually small enough so that when expressed in radians, it is approximately the same as its tangent. The procedure for constructing a spiral whose track curvature as a function of distance has been specified is well known in the field and is explained below. Although use of the roll functions of this invention in this alternate manner is considered inferior to the presently preferred use, such use is nevertheless included in the invention.

Consider the longitudinal axis about which the track appears to be rotated as a point of observation is advanced along a spiral. This axis is referred to as the "roll axis". Most traditional spiral design practice has located the roll axis in the plain of the track. However, it has been known for some time that track spiral shapes can be designed with the roll axis raised above the plain of the track. Moreover, Presle and Hasslinger (mentioned above) have reported that raising the roll axis height can help bring about substantial improvement in the dynamic performance of spirals. This invention includes the use of its novel elements in combination with the previously known principle of raising the height of the roll axis above the plain of the track.

In order to obtain actual spiral designs by the method of this invention it is necessary to carry out extensive mathematical calculations. To this end, sample spiral shapes (discussed below) have been calculated on an ordinary personal computer using computer programs that include roll function formulas selected in accordance with this invention. The programs allow selection of one of the included roll functions and then carry out the remaining steps of the method in a mechanical way and without introducing any other physical or geometrical ingredients except for conventions that are commonly used for presentation of results. Computer programs for implementing the steps of the method as disclosed in this application, and for obtaining the desired spiral shapes, will be readily understood by the person of ordinary skill both in the geometry of railroad track design and in writing computer programs for civil engineering design.

DESCRIPTION OF PREFERRED EMBODIMENTS

Figure 1:
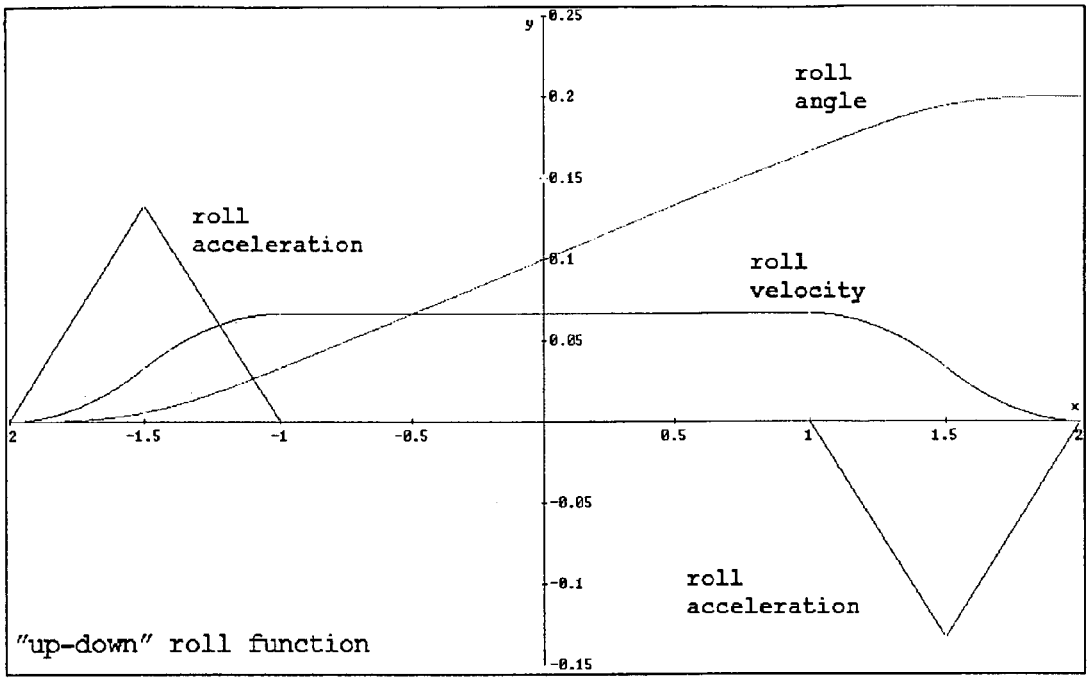
FIGS. 1 through 8 illustrate alternate roll functions, any one of which or any combination of which can be used as a roll function for the method of this invention.

The preferred method for designing a railroad curve transition spiral begins with choice of a mathematical function that defines the way that the longitudinal roll angle of the track (sometimes referred to as the bank angle or superelevation angle) should change as a function of distance along the spiral. A function used to specify how the roll angle changes with distance along a spiral is referred to herein as a "roll function". A roll function is denoted symbolically by r(s) where s stands for distance along the spiral.

The present method stipulates that for a function to be qualified for use as a roll function its second derivative with respect to distance must be zero at each end of the spiral and must be free from discontinuities throughout the length of the spiral. In addition, the present method prefers that a function to be used as a roll function should have a third derivative with respect to distance that is zero at each end of the spiral and free from discontinuities throughout the length of the spiral. This invention identifies a number of particular roll functions that are claimed to be suitable for defining spirals. These functions all have three parameters that are denoted herein as "a" (without quotes), roll_begin, and roll_change. The parameter a represents one half the length of the spiral, the parameter roll_begin is the roll angle at one end of the spiral, and the parameter roll_change is the amount by which the roll angle of the track changes over the whole length of the spiral. Some of the roll functions presented herein have one or two additional parameters.

When a spiral is being designed to be placed between and to connect two adjacent sections of constant curvature track, then the bank angle of each adjacent section is usually fixed from the outset. That means that the roll_begin and roll_change parameters are fixed and that the shape of the spiral will be determined by the spiral length and, in the cases of roll functions that have additional parameters, by the values of the additional parameters. The method includes roll functions that give better performance than the roll functions that are implicit in any of the prior spiral designs that have been proposed. The roll functions included in this invention are set forth below.

The present method includes the use of a well-known and generally accepted constraint that can be imposed between the roll angle at a given point along a spiral and the curvature of the track at that point. This constraint embodies the physical principle that the centripetal acceleration inherent in motion along a curved path should ideally be generated by the acceleration of gravity rather than by transverse force applied by the rails to the vehicle. This constraint is applied specifically to the components of centripetal acceleration and gravitational force that are transverse to the direction of travel and in the plane of the track. This constraint is expressed by the formula:

$$\text{track_curvature}=db/ds=(g/v_b^2)\tan(r(s)) \quad (1)$$

where b stands for the local compass bearing angle of the track in radians, s stands for distance along the track, db/ds stands for the derivative of the bearing angle with respect to the distance s, g stands for the acceleration of gravity, and $v_b$ is the so-called balance speed of the curve (that is, the vehicle speed at which the components of centripetal acceleration and gravitational acceleration parallel to the plane of the track are to be in balance).

For any given spiral to be designed according to the method of this invention, r(s) is a roll motion as a function of distance that meets the criteria of this invention (as described above in general terms and as elaborated in detail below). In the method of this invention, the forgoing equation is integrated with respect to distance to obtain b(s), where b(s) denotes the bearing angle as a function of distance. Then, letting x and y denote Cartesian coordinates of a general point on the spiral and letting dx/ds and dy/ds denote their derivatives with respect to s, the two equations:

$$dx/ds=\cos(b(s)), \text{ and} \quad (2)$$

$$dy/ds=\sin(b(s)) \quad (3)$$

are integrated with respect to the distance s to obtain the Cartesian coordinates of points along the alignment of the spiral.

The present method includes the use of the lesser known but previously published principle of taking the spiral path obtained by the forgoing integrations to be the path of the axis about which the track is rolled, of raising that axis above the plane of the track, and of obtaining the alignment of the track from the simple geometrical formulae:

$$x_t=x_r+h*\sin(r(s))*\sin(b(s)), \text{ and} \quad (4)$$

$$y_t=y_r-h*\sin(r(s))*\cos(b(s)) \quad (5)$$

where $x_t$ and $y_t$ are the coordinates of a point on the track and $x_r$ and $y_r$ are corresponding points on the path of the roll axis, h stands for the height of the roll axis, and b(s) is the compass bearing angle (relative to the x axis) of the path of the roll axis at distance s.

When the alignment of existing railroad track is being modified, it is often necessary to find a spiral shape that will properly connect two pre-existing sections of track that have given curvatures and a given offset. The present method includes the following recipe for finding the value for the spiral half length parameter, a, such that a spiral based on a particular roll function will correctly join the two adjacent track sections:

Step 1) If the roll function has more parameters than just roll_begin, roll_change and the half-length, a, then choose values for the additional parameters.

Step 2) Choose an initial value for the half-length parameter, a.

Step 3) Integrate equation (1) to obtain the track direction compass bearing as a function of distance along the spiral. The integration can be done numerically. Then integrate equations (2) and (3) to obtain the x and y coordinates of the end of the spiral path of the roll axis relative to the start of the spiral. Then apply equations (4) and (5) to obtain the coordinates of points along the track spiral relative to the start of the track spiral.

Step 4) Apply simple trigonometry to determine what the value that the offset between the adjacent curves (or curve and straight track) would be if connected by the spiral just calculated.

Step 5) Based on the difference between the pre-established offset and the offset corresponding to the spiral shape just calculated, determine a correction to the spiral length.

Step 6) Repeat steps 3) through 5) until the difference between the pre-assigned and calculated offsets becomes negligible. The final track spiral can connect the adjacent track sections.

Step 7) If the roll function being used has additional parameters, then repeat steps 2) through 6) for a sequence of values of the additional parameters and examine how this affects spiral characteristics such as maximum track warp, maximum roll acceleration, and maximum roll jerk (jerk being the derivative of acceleration).

In the spiral design method of this invention, a spiral is fully defined by the roll angle function that is selected, by the initial and final roll angles, by the spiral length selected, and by the values assigned to parameters such as f and c (described above) if the selected roll function has such parameters. The initial and final roll angles are fixed because they must equal the bank angles of the adjacent track section that are to be connected by the spiral. A spiral that conforms to a prescribed offset is found by iterative adjustment of the spiral length. If the selected roll function has additional parameters, such parameters can be varied either to reduce the maximum track warp in the spiral or to reduce the maximum angular acceleration or angular jerk in the spiral.

Figure 2:
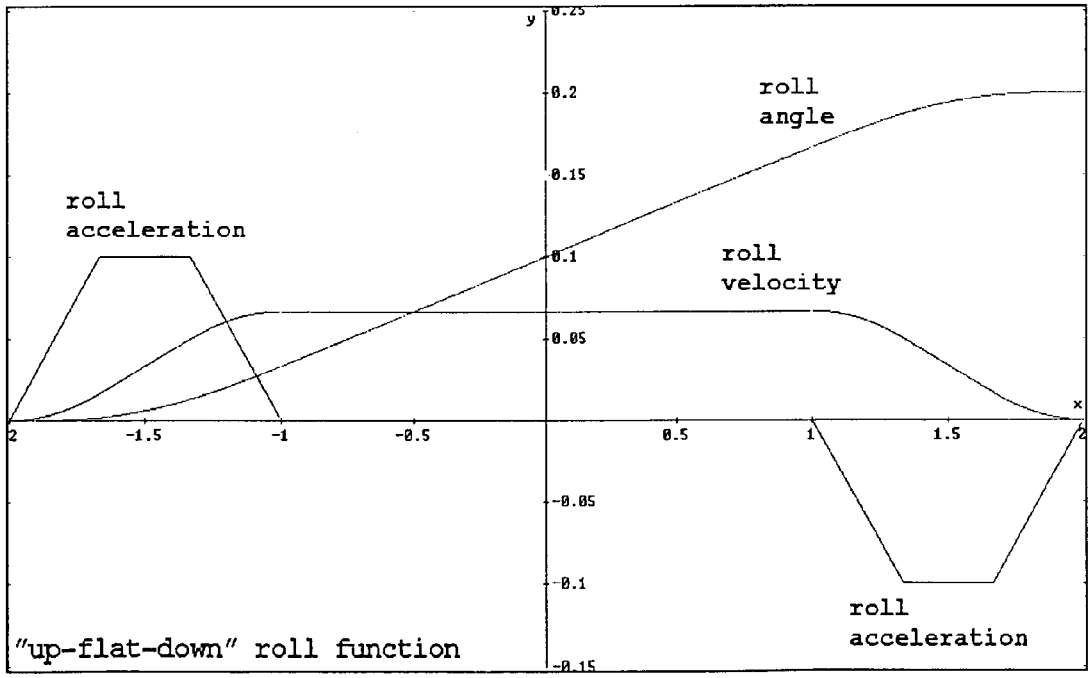

Examples of the roll functions that are included in this method are enumerated below. Each example roll function is defined by the mathematical formula for the second derivative of roll angle with respect to distance along the spiral (referred to as the "roll acceleration"). Each of the included roll acceleration functions has value zero at each end of the spiral and is continuous throughout the spiral. The roll functions that-are preferred are those for which the angular jerk (the derivative of the roll acceleration with respect to distance) is also zero at each end of the spiral and continuous throughout the spiral. Thus, while the roll functions illustrated in FIGS. 1 and 2 are included in the present method, such roll functions are presently considered to be less effective than the roll functions illustrated in FIGS. 3 through 8.

The principle of raising the roll axis above the plane of the track is not in itself a part of this invention. However, the method of this invention calls for the roll axis to be raised above the plane of the track unless there is some constraint unrelated to spiral geometry per se that makes raising the roll axis impractical. The superiority of the roll functions corresponding to FIGS. 3 through 8 is particularly apparent when the roll axis is raised above the plane of the track.

A linear combination of two or more of the included roll functions with individual weightings that add to unity (so that the roll_change is not altered) can serve as an additional roll function and such combinations are also included in the method of this invention.

The formulae given below embody the following conventions:

a) Distance along the spiral is called 's', and s=0.0 at the midpoint of the spiral.

b) The spiral extends from s=−a to s=+a, so that the spiral has the length 2*a*.

c) Each of the roll functions corresponding to a figure in the range from 1) through 5) (and the "quartic-and-flat" and "hexic" functions that are not illustrated) has a central zone in which roll acceleration is identically zero. Functions in this group are sometimes referred to as "piecewise" functions. For each of those functions, the central zone extends from s=−fa to s=+fa, so that the parameter 'f' is the ratio of the length of the central zone to the length of the whole spiral.

d) The final roll angle minus the initial roll angle is called "roll_change".

This invention includes a family of roll acceleration functions that are identified herein by the term order(m,n), where m is an integer greater than 1 and n is an integer greater than 0. The general form of a roll function in this family is a product of three parts as follows:

1) the factors $-(a+s)^m(a-s)^m s|s|^{(n-1)}$ that give the dependence on distance, s,
2) the factor roll_change, and
3) a normalization constant that depends only on m, n, and a.

In the above expression |s| represents the absolute value of s. The normalization constant for given values of m and n is defined by the requirement that the change in roll angle over the length of the spiral must equal roll_change. The normalization constant for particular values of m and n can be found using a symbolic algebra computer program such as the program "Derive" which is currently available from Texas Instruments, Inc. Some of the order(m,n) roll acceleration functions that presently appear to be useful for track spirals are listed below and illustrated in the figures. However, all the functions of the order(m,n) form, including order(m,n) functions with n an even positive integer, are included in the invention.

Additional roll acceleration functions in accordance with the present invention can be obtained by applying non-linear transformations of a particular type to any one of the roll acceleration functions explicitly defined herein. For illustration, consider the roll acceleration function denoted herein as order(2,3). Giving this roll acceleration the temporary name accel(s), it results (from Table 1 below) that:

$$\text{accel}(s)=-315\ \text{roll_change}(a+s)^2(a-s)^2s^3/(16a^9).$$

Applying to accel(s) the non-linear transformation defined by taking its absolute value, raising the absolute value to the 3/2 power, and multiplying the result by −SIGN(s), the following new function results:

$$\text{accel_transformed}(s)=-\text{SIGN}(s)|\text{accel}(s)|^{3/2}$$

This non-linear transformation has the three characteristics that 1) the new function is zero whenever accel(s) is zero, 2) at each value of s along the spiral, the first derivative with respect to s of the new function and of accel(s) are both zero or else both have the same sign, and 3) the new function has the same antisymmetry about s=0 that accel(s) has.

The foregoing three characteristics define the type of non-linear transformations by which additional roll acceleration functions can be obtained from roll acceleration functions explicitly defined herein. The new roll acceleration function can be integrated twice to obtain the corresponding new roll angle function and then the new functions can be renormalized (i.e., constant factors that are applied respectively to each one as a whole can be adjusted) so that the new roll function embodies the desired value of roll_change. For some combinations of a given roll acceleration function and a non-linear transformation thereof the two integrations that need to be performed to obtain the additional roll function are done analytically, and for other combinations they are done numerically. Multiplying one of the first seven roll acceleration functions defined explicitly below by an even function of s such as |s| or $s^2$ or (|s|−a) or (|s|−fa) and renormalizing the transformed function constitutes another example of a non-linear transformation by which an additional roll acceleration function can be obtained from a selected roll acceleration function.

Formulae are presented below as examples of roll acceleration functions. The formulae for the roll velocity (i.e., the first derivative of roll angle with respect to distance along the spiral) and for the roll angle itself are obtained in closed form (i.e., in terms of standard mathematical functions) for these example roll acceleration functions by successive integrations from s=−a to a general point, s, within the spiral. The integration constant for the roll velocity is always zero. The integration constant for the roll angle is the roll angle at the beginning of the spiral where s=−a. Results of these integrations are illustrated in the figures.

Each of the order(m,n) roll functions that is listed herein is given below in its entirety. In the case of the piecewise functions that correspond to FIGS. 1 through 5 and the "quartic-and-flat" and "hexic" functions, the general expressions are more complex, and each one is represented in the following table by the formula that applies in the first zone on the left of the corresponding plot. The general formulae for the piecewise roll functions are given separately below.

TABLE 1

| Fig. | Function name | Formula |
|---|---|---|
| 1 | Up-down | 4 roll_change (a + s)/($a^3$ (1 + f) (1 − $f^2$) |
| 2 | Up-flat-down | 4 roll_change (a + s)/ ($a^3$ (1 − $c^2$) (1 + f) (1 − $f^2$) |
| 3 | Quartic | 30 roll_change (\|s\| − a)$^2$ (\|s\| − fa)$^2$/ ($a^6$ (1 + f) (1 − f)$^5$) |
| * | Quartic & flat | 120 roll_change (a + s)$^2$ (a (1 + f − c (1 − f)) + 2s)$^2$/($a^6$ (1 − c)$^2$ (1 + f) (1 − f)$^5$ (1 + 89$c^3$ + 23$c^2$ + 7c)) |
| * | Hexic | 140 roll_change (\|s\| − a)$^3$ (\|s\| − af)$^3$/ ($a^8$ (1 + f) (1 − f)$^7$) |
| 4 | Raised sine | roll_change (sin((4 pi \|s\| − pi a (3f + 1))/ (2a (1 − f))) + 1)/($a^2$ (1 − $f^2$)) |
| 5 | Raised sine & flat | roll_change (cos(2 pi (a − \|s\|)/(a (1 − f) (1 − c))) − 1 )/($a^2$ (1 + c) (1 − $f^2$)) |
| 6 | Order (2, 1) | 105 roll_change (a + s)$^2$ (a − s)$^2$ s/(16 $a^7$) |
| * | Order (3, 1) | 315 roll_change (a + s)$^3$ (a − s)$^3$ s/(32 $a^9$) |
| 7 | Order (2, 3) | 315 roll_change (a + s)$^2$ (a − s)$^2$ $s^3$/ (16 $a^9$) |
| * | Order (3, 3) | 1155 roll_change (a + s)$^3$ (a − s)$^3$ $s^3$/ (32 $a^{11}$) |
| * | Order(4, 3) | 15015 roll_change (a + s)$^4$ (a − s)$^4$ $s^3$/ (256 $a^{13}$) |
| * | Order (2, 5) | 693 roll_change (a + s)$^2$ (a − s)$^2$ $s^5$/ (16 $a^{11}$) |
| * | Order (3, 5) | 3003 roll_change (a + s)$^3$ (a − s)$^3$ $s^5$/ (32 $a^{13}$) |
| * | Order (4, 5) | 45045 roll_change (a + s)$^4$ (a − s)$^4$ $s^5$/ (256 $a^{15}$) |
| * | Order (2, 7) | 1287 roll_change (a + s)$^2$ (a − s)$^2$ $s^7$/ (16 $a^{13}$) |
| 8 | Order (3, 7) | 6435 roll_change (a + s)$^3$ (a − s)$^3$ $s^7$/ (32 $a^{15}$) |
| * | Order (4, 7) | 109395 roll_change (a + s)$^4$ (a − s)$^4$ $s^7$/ (256 $a^{17}$) |

* Roll functions marked with an asterisk (*) are not illustrated by a figure.

FIGS. 1 through 8 illustrate selected roll functions as identified in the following list. Each figure has labeled curves representing the roll angle as a function of distance, its derivative, the roll velocity, and its second derivative, the roll acceleration. The title applied to each figure is intended to describe the shape of the roll acceleration. Each roll function is best characterized by the form of the roll acceleration. To facilitate comparison among the roll functions, each plot has its distance axis scaled to extend from −2.0 to +2.0 and takes the roll angle from 0.0 to 0.2.

FIG. 1 shows a linear "up-down" roll function. In this roll function the acceleration is piecewise linear with a central section of variable width in which the roll acceleration is identically zero.

FIG. 2 shows a linear "up-flat-down" roll function. This roll function is like the linear "up-down" function except that each zone of non-zero acceleration is divided into three sub-zones with the roll acceleration held constant in the central sub-zone.

Figure 3:
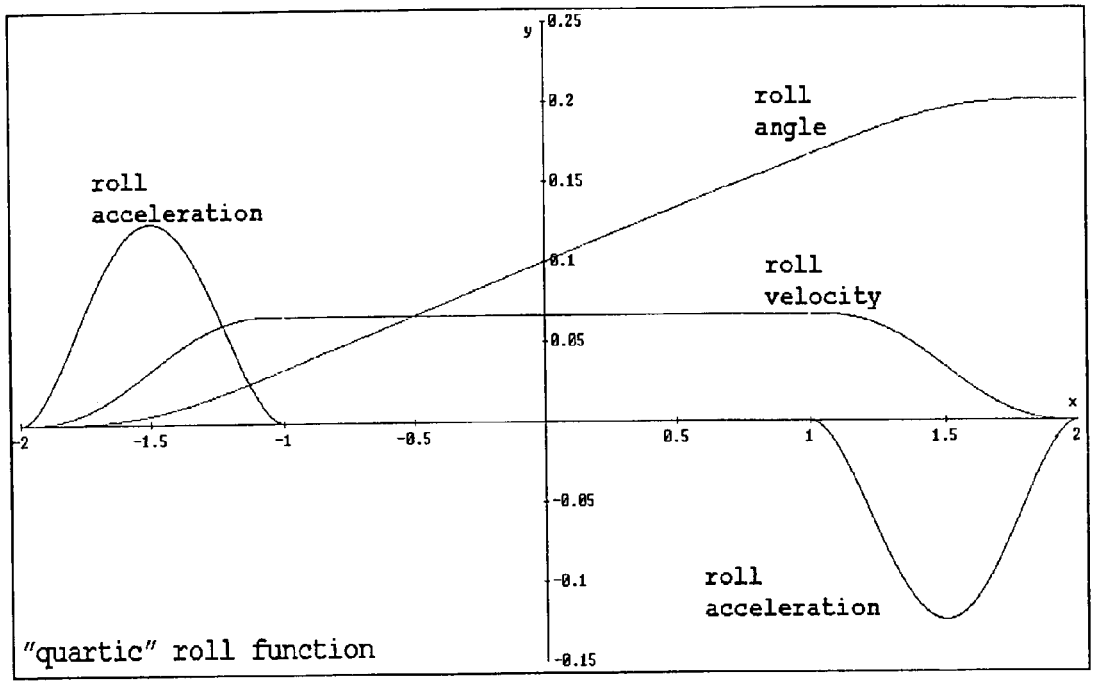

FIG. 3 shows a "Quartic" roll function. This roll function is referred to here as quartic because the roll acceleration is given by a $4^{th}$ order polynomial except in the central zone where it is identically zero. It has a $2^{nd}$ order zero at each of the four points where:

$$|s|=a \text{ or } |s|=f\ a.$$

Figure 4:
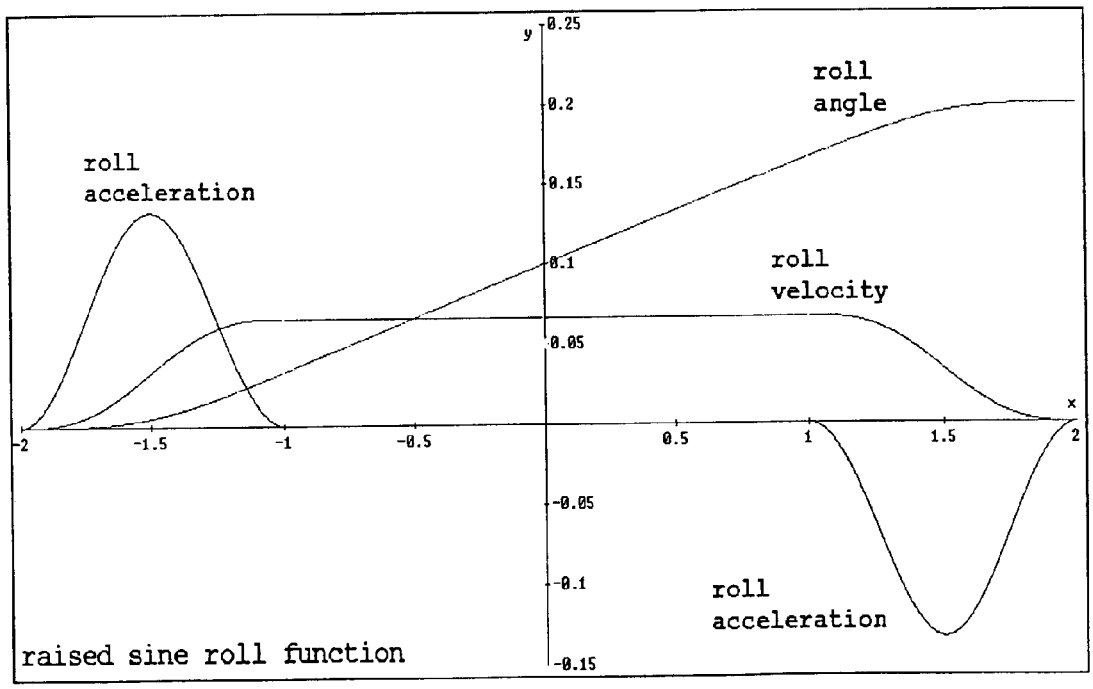

FIG. 4 shows a raised sine roll function. This roll function looks and behaves very much like the quartic function. However, where its acceleration is non-zero at each end it is formed by elevating a full cycle of a sine curve.

Figure 5:
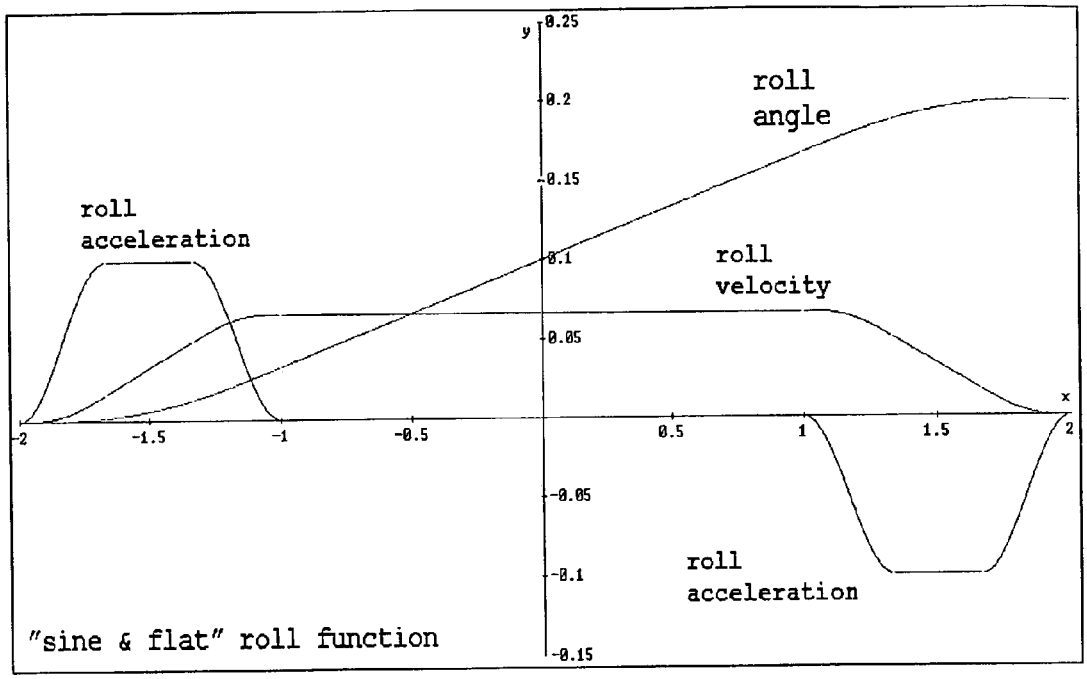

FIG. 5 shows a raised "sine & flat" roll function. This is a variant of the previous function, and is analogous to the "up-flat-down" function.

Figure 6:
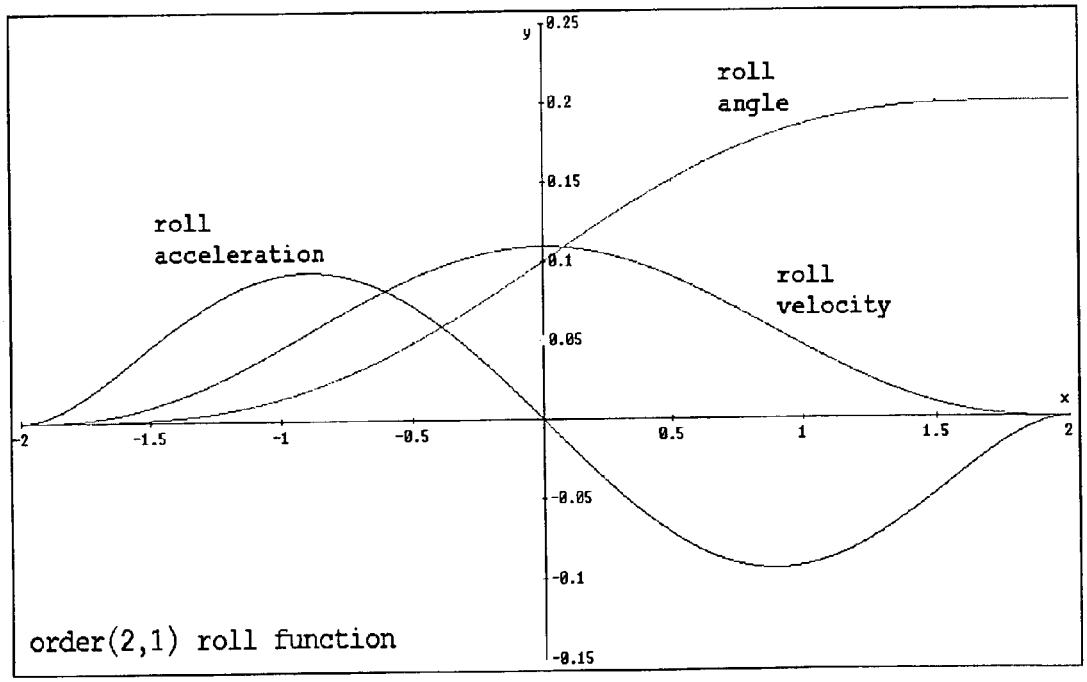

FIG. 6 shows an order (2,1) roll function. Each of the preceding roll functions is derived from a roll acceleration function constructed with multiple zones and with the mathematical form changing from zone to zone. By way of contrast, this roll function and those that follow are based on respective single polynomial expressions that apply over the whole length of the spiral. This roll function is referred to as order (2,1) to indicate that the roll acceleration curve has a $2^{nd}$ order zero at each end of the spiral and a $1^{st}$ order zero in the center of the spiral. The functions that follow are labeled analogously by the order of the zero at each end of the spiral and the order of the zero in the center of the spiral.

Figure 7:
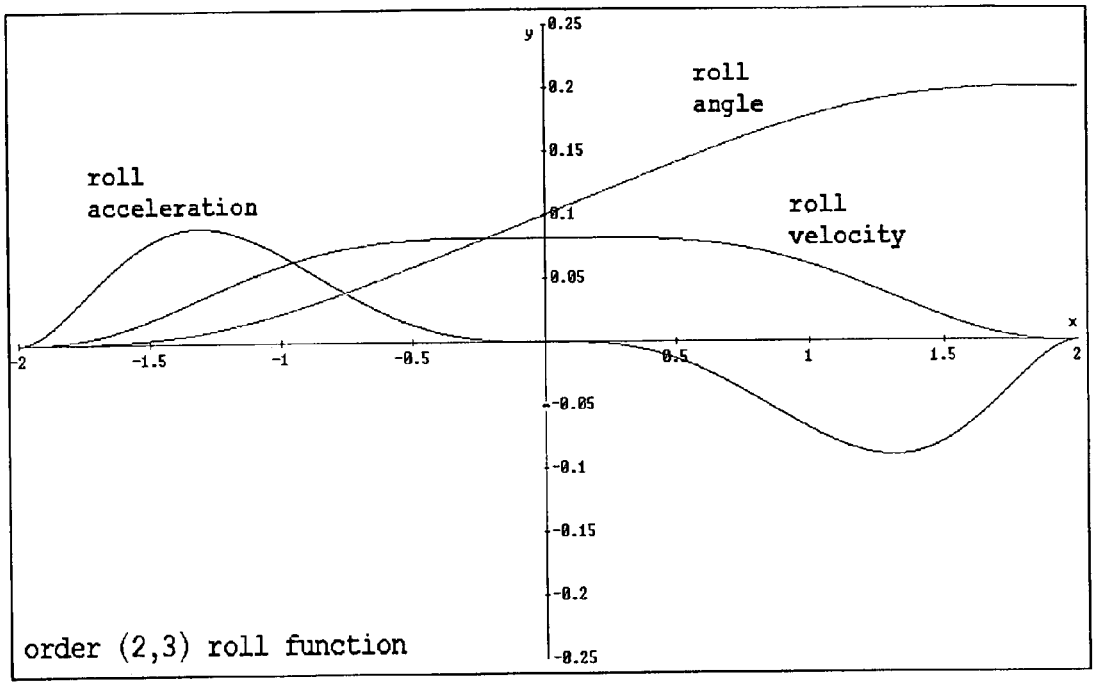

FIG. 7 similarly shows an order (2,3) roll function.

Figure 8:
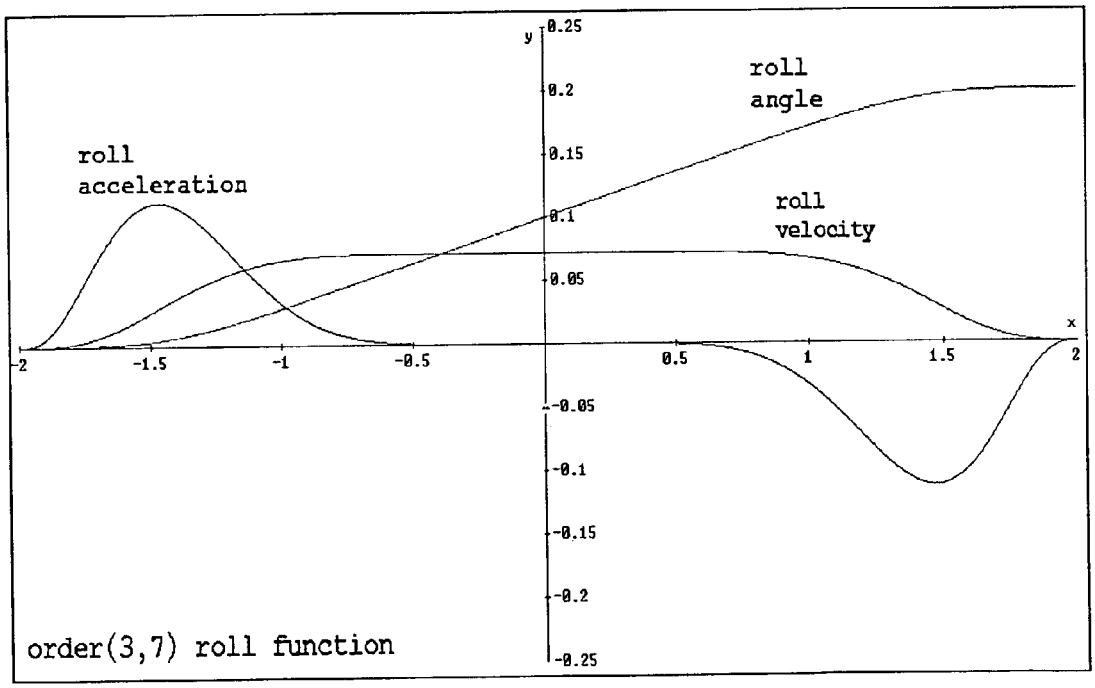

FIG. 8 similarly shows an order (3,7) roll function.

Figure 9:
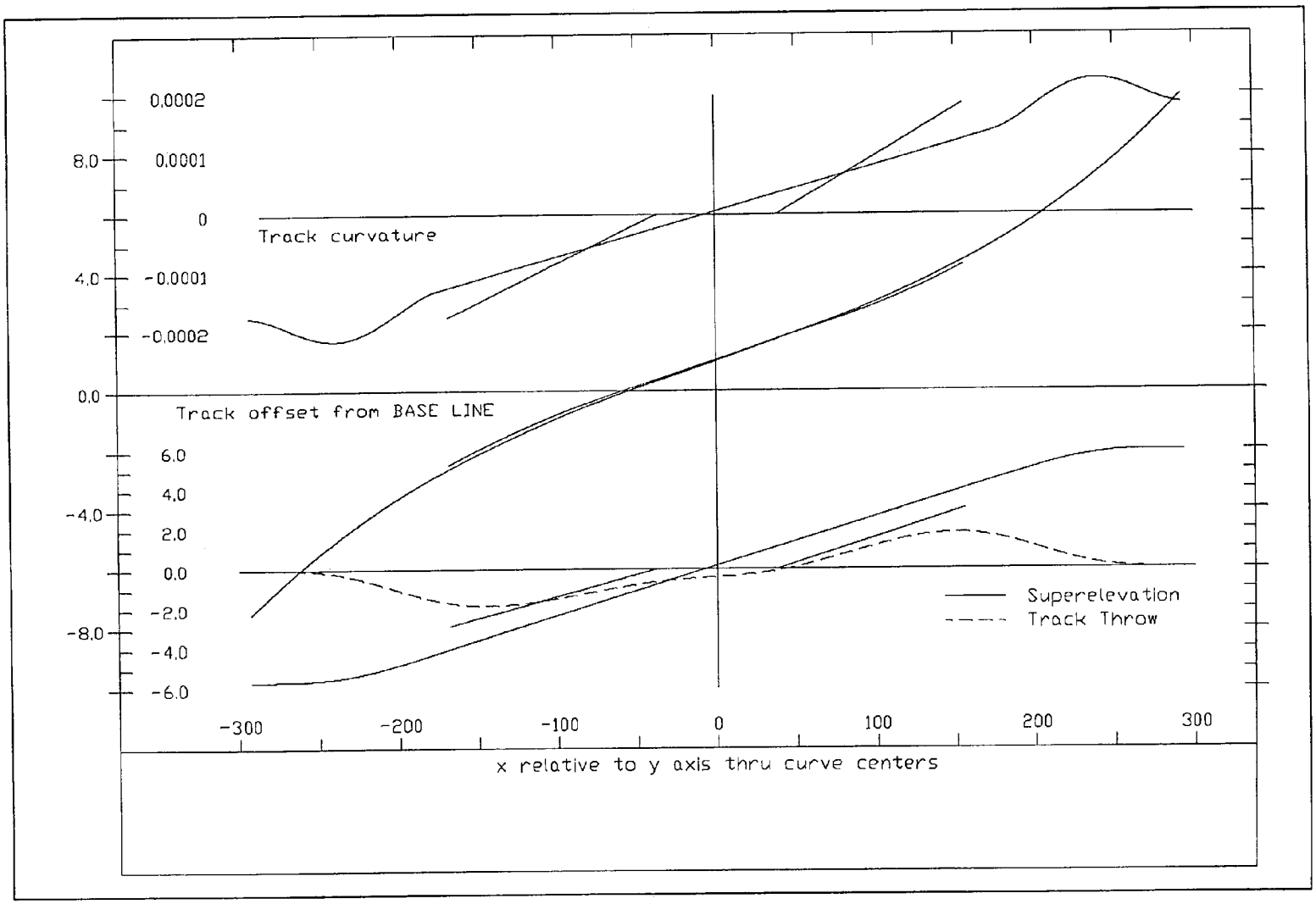
FIGS. 9 and 10 are plots that illustrate spirals produced according to the method of this invention in comparison to traditional spirals in two existing railroad track locations.
Figure 10:
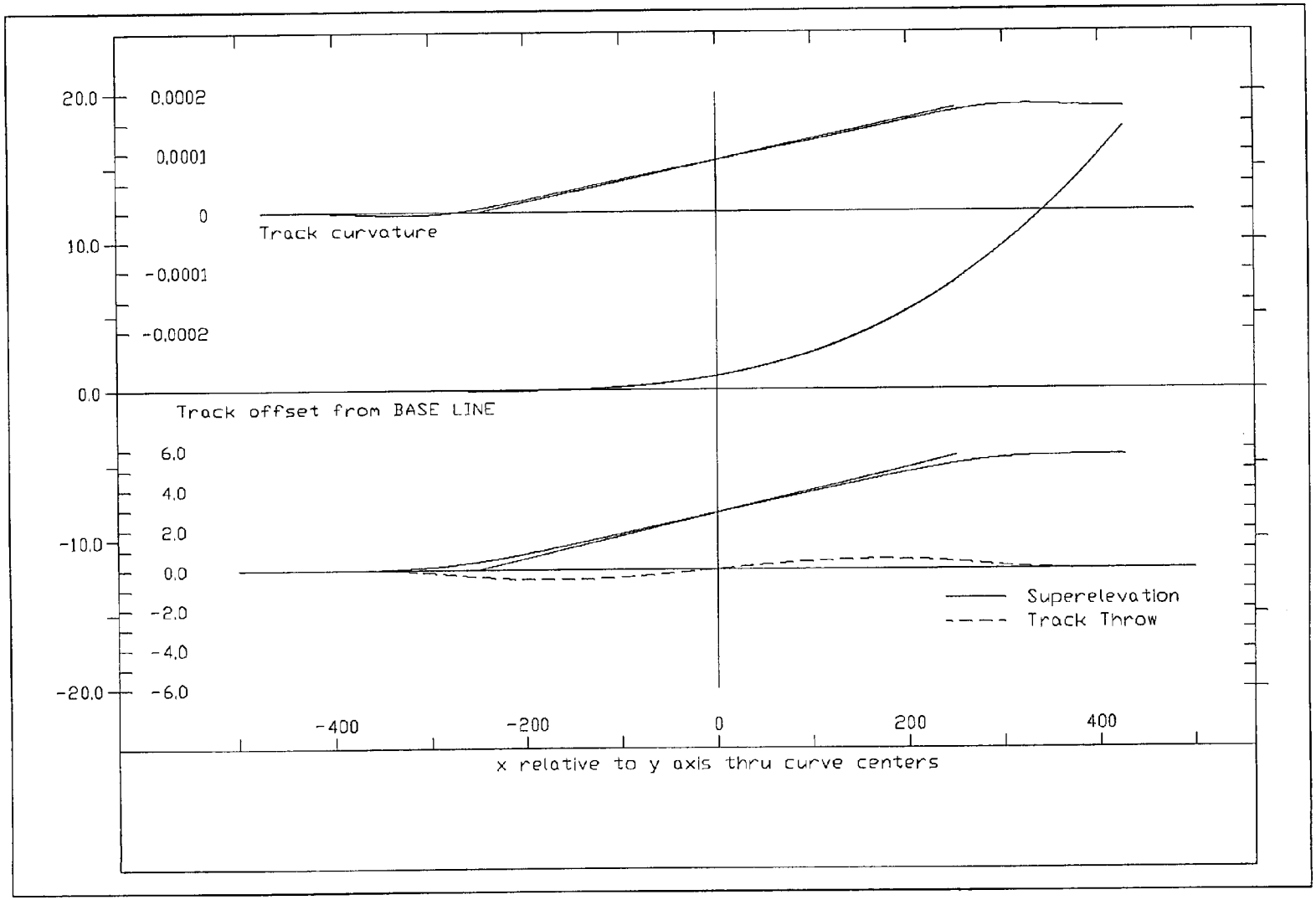

Examples of practical spirals designed according to the method of this invention are illustrated in the plots of FIGS. 9 and 10, which compare spirals designed according to the method of this invention with traditional spirals in two existing railroad track locations. In FIGS. 9 and 10, the curves depicting curvature and superelevation of spirals designed according to the method of this invention can be distinguished from their counterparts for traditional spirals by the fact that the latter are composed entirely of straight-line segments and do not extend as far from the center of the figure in either direction. The upper part of each plot shows track curvatures, the middle part of each plot shows the spiral alignments in plan view, and the lower part of each plot shows both the superelevations and, via the dashed curve, the lateral distance between the traditional spiral alignment and the alignment of the spiral designed according to the method of this invention. In the middle part of each plot the x-axis is tangent to a constant curvature extension of the curve or tangent track that approaches the spiral from the left. FIG. 9 is provided for a pair of so-called "reverse curves" (i.e., two curves that are in opposite directions and that are so close together that most or all of the distance between them is occupied by a spiral or pair of spirals). FIG. 10 is an example of a simple transition from tangent track to a curve.

FIG. 9 illustrates an example with a 7 ft. roll axis height and roll function="Quartic" with length of central zero acceleration zone=60% of whole length of spiral. The traditional spiral is designed for a balancing speed of 64 mph and the improved spiral is designed for a balancing speed of 90 mph.

FIG. 10 similarly illustrates an example with a 7 ft. roll axis height and roll model order(3,5). The improved and traditional spirals are both designed for a balancing speed of 90 mph.

Formulae for the roll accelerations (the second derivatives of roll angle with respect to distance along the spiral) for the piecewise functions that correspond to FIGS. 1 through 5 (and for the "quartic-and-flat" and "hexic" functions that are not illustrated) are given in C programming language notation as follows. The formulae make use of the sin(x) and cos(x) trigonometric functions plus the following three other functions:

1) fabs(s) is the absolute value of s;
2) sign(x) is −1 for x<0, is 0 for x=0, and is +1 for x>0; and
3) pow(a,n) is a raised to the power n.

For FIG. 1 (Up-down):

$$-2*\text{rotation}*(\text{sign}(2*\text{abs}(s)-a*(f+1))*(a*(f+1)*\text{sign}(s)-2*s)+$$
$$\text{sign}(\text{abs}(s)-a*f)*(s-a*f*\text{sign}(s))+$$

-continued $$\text{sign}(\text{abs}(s)-a)*(s-a*\text{sign}(s)))/$$
$$(pow(a,3)*(f+1)*(pow(f,2)-2*f+1))$$

For FIG. 2 (Up-flat-down):

$$\text{rotation}*(\text{sign}(2*\text{abs}(s)-a*(c*(f-1)+f+1))*$$
$$(a*(c*(f-1)+f+1)*\text{sign}(s)-2*s)-$$
$$\text{sign}(2*\text{abs}(s)+a*(c*(f-1)-f-1))*$$
$$(a*(c*(f-1)-f-1)*\text{sign}(s)+2*s)+$$
$$\text{sign}(\text{abs}(s)-a*f)*(2*s-2*a*f*\text{sign}(s))+$$
$$\text{sign}(\text{abs}(s)-a)*(2*s-2*a*\text{sign}(s)))/$$
$$(pow(a,3)*(c+1)*(c-1)*f+1)*pow(f-1,2))$$

For FIG. 3 (Quartic):

$$15*\text{r_end}*((pow(a,4)*pow(f,2)+$$
$$pow(a,2)*pow(s,2)*(pow(f,2)+4*f+1)+pow(s,4))*$$
$$\text{sign}(s)-2*a*s*(f+1)*(pow(a,2)*f+pow(s,2)))*$$
$$(\text{sign}(\text{abs}(s)-a*f)-\text{sign}(\text{abs}(s)-a))/$$
$$(pow(a,6)*(f+1)*pow(f-1,5))$$

For Quartic & flat:

$$60*\text{roll_change}*(\text{sign}(2*\text{abs}(s)-a*(c*(f-1)+f+1))*$$
$$((pow(a,4)*(pow(c,4)*pow(f-1,4)-$$
$$2*pow(c,3)*pow(f-1,4)+pow(c,2)*pow$$
$$(f-1,2)*(1-2*f)+2*c*pow(f,2)*$$
$$(f+1)*(f-1)-pow(f,2)*pow(f+1,2))-$$
$$pow(a,2)*pow(s,2)*(pow(c,2)*pow(f-1,2)+$$
$$2*c*(1-f)*(5*f+1)+13*pow(f,2)+$$
$$10*f+1)-4*pow(s,4))*\text{sign}(s)+$$
$$2*a*s*(pow(a,2)*f*(c*(f-1)-f-1)-2*pow(s,2))*$$
$$(c*(f-1)-3*f-1))-$$
$$\text{sign}(2*\text{abs}(s)+a*(c*(f-1)-f-1))*$$
$$((pow(a,4)*(pow(c,4)*pow(f-1,4)-2*pow(c,3)*pow$$
$$(f-1,4)+pow(c,2)*f*(f-2)*pow(f-1,$$
$$2)+2*c*(f+1)*(1-f)-pow(f+1,2))-$$
$$pow(a,2)*pow(s,2)*(pow(c,2)*pow(f-1,2)+$$
$$2*c*(f-1)*(f+5)+pow(f,2)+10*f+13)-$$
$$4*pow(s,4))*\text{sign}(s)+2*a*s*$$
$$(pow(a,2)*(c*(f-1)+f+1)+2*pow(s,2))*$$
$$(c*(f-1)+f+3))+\text{sign}(\text{abs}(s)-a*f)*$$
$$((pow(a,4)*pow(f,2)*pow(c*(f-1)-f-1,2)+$$

-continued $$pow(a, 2)*pow(s, 2)*(pow(c, 2)*pow(f-1, 2)+$$
$$2*c*(1-f)*(5*f+1)+13*pow(f, 2)+$$
$$10*f+1)+4*pow(s, 4))*\text{sign}(s)-$$
$$2*a*s*(pow(a, 2)*f*(c*(f-1)-f-1)-2*pow(s, 2))*$$
$$(c*(f-1)-3*fl))+\text{sign}(\text{abs}(s)-a)*$$
$$(2*a*s*(pow(a, 2)*(c*(f-1)+f+1)+2*pow(s, 2))*$$
$$(c*(f-1)+f+3)-$$
$$(pow(a, 4)*pow(c*(f-1)+f+1, 2)+$$
$$pow(a, 2)*pow(s, 2)*$$
$$(pow(c, 2)*pow(f-1, 2)+2*c*(f-1)*(f+5)+$$
$$pow(f, 2)+10*f+13)+4*pow(s, 4))*sign(s)))/$$
$$(pow(a, 6)*pow(c-1, 2)*(f+1)*pow(f-1, 5)*(89*$$
$$pow(c, 3)+23*pow(c, 2)+7*c+1))2$$

For Hexic:

$$70*\text{roll_change}*((pow(a, 6)*pow(f, 3)+$$
$$3*pow(a, 4)*f*pow(s, 2)*(pow(f, 2)+3*f+1)+$$
$$3*pow(a, 2)*pow(s, 4)*(pow(f, 2)+3*f+1)+pow(s, 6))*$$
$$\text{sign}(s)-a*s*(f+1)*(3*pow(a, 4)*pow(f, 2)+$$
$$pow(a, 2)*pow(s, 2)*(pow(f, 2)+8*f+1)+3*pow(s, 4)))*$$
$$(\text{sign}(\text{abs}(s)-a*f)-\text{sign}(\text{abs}(s)-a))/$$
$$(pow(a, 8)*(f+1)*pow(1-f, 7))$$

For FIG. 4 (Raised sine):

$$\text{r_end}*\text{sign}(s)*(sign(\text{abs}(s)-a*f)-\text{sign}(\text{abs}(s)-a))*$$
$$(\sin(2*pi*\text{abs}(s)/(a*(f-1))+pi*(3*f+1)/(2*(1-f)))-1)/$$
$$(2*pow(a, 2)*(1-pow(f, 2)))$$

For FIG. 5 (Raised sine & flat):

$$\text{roll_change}*\text{sign}(s)*(\text{sign}(2*\text{abs}(s)-a*(c*(f-1)+f+1))*$$
$$(\cos(2*pi*\text{abs}(s)/(a*(c*(f-1)-f+1))-$$
$$2*pi*f/(c*(f-1)-f+1))+1)-$$
$$\text{sign}(2*\text{abs}(s)+a*(c*(f-1)-f-1))*$$
$$(\cos(2*pi*\text{abs}(s)/(a*(c-1)*(f-1))+$$
$$2*pi/((1-f)*(c-1)))+1)+\text{sign}(\text{abs}(s)-a*f)*$$
$$(1-\cos(2*pi*\text{abs}(s)/(a*(c*(f-1)-(f+1))-$$
$$2*pi*f/(c*(f-1)-f+1)))+$$
$$\text{sign}(\text{abs}(s)-a)*(\cos(2*pi*\text{abs}(s)/(a*(c-1)*(f-1))+$$
$$2*pi/((1-f)*(c-1)))-1))/$$
$$(2*pow(a, 2)*(c+1)*(pow(f, 2)-1))$$

I claim:

1. A computer-implemented method for designing a railroad track curve transition spiral comprising the steps of:

a) choosing a mathematical expression that is a function of distance along the spiral, that specifies a value of the bank or roll angle of the track as a function of the distance along the spiral, and that includes a length of the spiral as a variable parameter;

b) establishing balance at each point along the spiral between transverse components of centripetal and gravitational acceleration in a plane defined by the track for a vehicle traversing the track at a designated speed;

c) integrating a differential equation expressing the established balance with respect to the distance along the spiral, obtaining, as a function of the distance along the spiral, a compass-bearing angle of the track relative to a bearing angle of the track at the beginning of the spiral;

d) integrating sine and cosine expressions that are the sine and the cosine of the track compass bearing angle obtained in the preceding integration with respect to the distance along the spiral to obtain Cartesian coordinates of points along the spiral relative to coordinates of the beginning of the spiral, thereby completing definition of the spiral corresponding to the chosen mathematical expression; and e) repeating steps a) through d) with different choices for the chosen mathematical expression until a spiral shape is provided that substantially connects to neighboring track at each end of the spiral.

2. The method of claim 1 wherein a second derivative with respect to the distance along the spiral of the chosen mathematical expression for the roll angle is zero at each end of the spiral, is composed of segments that are linear functions of distance along the spiral, and is continuous as a function of the distance along the spiral.

3. The method of claim 2 which further includes the step of raising a height of the longitudinal axis about which the track bank or roll angle changes with the distance along the spiral so that the axis is above the plane of the track.

4. The method of claim 1 wherein the chosen mathematical expression has second and third derivatives with respect to the distance along the spiral, both of which are continuous throughout the length of the spiral and both of which have a value zero at each end of the spiral.

5. The method of claim 4 which further includes the step of raising a height of the longitudinal axis about which the track bank or roll angle changes with the distance along the spiral so that the axis is above the plane of the track.

6. A computer-implemented method for designing a railroad track curve transition spiral comprising the steps of:

a) choosing a mathematical expression that is a function of distance along the spiral and that specifies a value of the curvature of the track as a function of the distance along the spiral, that includes a length of the spiral as a variable parameter, that has a second derivative with respect to the distance along the spiral that is zero at each end of the spiral, that is composed of segments that are linear functions of the distance along the spiral, and that is continuous as a function of the distance along the spiral;

b) integrating the chosen mathematical expression for the track curvature with respect to the distance along the spiral to obtain, as a function of the distance along the spiral, a compass-bearing angle of the track relative to a bearing angle of the track at the beginning of the spiral;

c) integrating sine and cosine expressions that are the sine and the cosine of the track compass bearing angle obtained in the preceding integration with respect to the distance along the spiral, obtaining Cartesian coordinates of points along the spiral relative to coordinates of the beginning of the spiral, thereby completing definition of the spiral corresponding to the chosen mathematical expression; and d) repeating steps a) through c) with different choices for the chosen mathematical expression until a spiral shape is provided that substantially connects to neighboring track at each end of the spiral.

7. The method of claim 6 which further includes the step of raising a height of the longitudinal axis about which the track bank or roll angle changes with the distance along the spiral so that the axis is above the plane of the track.

8. A computer-implemented method for designing a railroad track curve transition spiral comprising the steps of:

a) choosing a mathematical expression that is a function of distance along the spiral and that specifies a value of the curvature of the track as a function of the distance along the spiral, that includes a length of the spiral as a variable parameter, that has second and third derivatives with respect to the distance along the spiral that are both continuous throughout the length of the spiral and that both have a value zero at each end of the spiral;

b) integrating the chosen mathematical expression for the track curvature with respect to the distance along the spiral to obtain, as a function of the distance along the spiral, a compass-bearing angle of the track relative to a bearing angle of the track at the beginning of the spiral;

c) integrating sine and cosine expressions that are the sine and the cosine of the track compass bearing angle obtained in the preceding integration with respect to the distance along the spiral, obtaining Cartesian coordinates of points along the spiral relative to coordinates of the beginning of the spiral, thereby completing definition of the spiral corresponding to the chosen mathematical expression; and d) repeating steps a) through c) with different choices for the chosen mathematical expression until a spiral shape is provided that substantially connects to neighboring track at each end of the spiral.

9. The method of claim 8 which further includes the step of raising a height of the longitudinal axis about which the track bank or roll angle changes with the distance along the spiral so that the axis is above the plane of the track.

* * * * *